US005779528A

United States Patent [19]

Tartaglione

[11] Patent Number: 5,779,528

[45] Date of Patent: Jul. 14, 1998

[54] ELASTOMERIC MOUNT FOR GRINDING WHEEL, AND GRINDER

[75] Inventor: John J. Tartaglione, Hopkinton, Mass.

[73] Assignee: Norton Company, Worcester, Mass.

[21] Appl. No.: 678,865

[22] Filed: Jul. 12, 1996

[51] Int. Cl.[6] ..... B23P 11/02; B24B 23/02

[52] U.S. Cl. ..... 451/358; 29/446; 29/452; 451/513; 451/543

[58] Field of Search ..... 451/541, 513, 451/540, 542, 543, 546, 344, 352, 354, 358; 29/452, 428, 446, 469; 51/293; 15/230.14

[56] References Cited

U.S. PATENT DOCUMENTS

| | | | |
|---|---|---|---|
| 2,078,120 | 4/1937 | Beth . | |
| 2,453,748 | 11/1948 | Fisher et al. . | |
| 3,171,237 | 3/1965 | Howard . | |
| 4,212,137 | 7/1980 | Rue . | |
| 4,672,778 | 6/1987 | Rieser | 451/549 X |
| 4,961,120 | 10/1990 | Hawkes et al. . | |
| 4,961,290 | 10/1990 | Hawkes et al. | 451/543 X |
| 4,979,337 | 12/1990 | Duppstadt | 451/549 X |
| 5,185,967 | 2/1993 | Cutsforth | 451/557 X |
| 5,318,603 | 6/1994 | Scheider et al. | 51/293 |
| 5,529,529 | 6/1996 | Judge et al. | 451/513 X |

FOREIGN PATENT DOCUMENTS

| | | |
|---|---|---|
| 2123957 | 11/1994 | Canada . |
| 779058 | 11/1980 | U.S.S.R. . |

*Primary Examiner*—Timothy V. Eley
*Attorney, Agent, or Firm*—Mary E. Porter

[57] ABSTRACT

An elastomeric mount or band is provided for circumferential placement about a bonded abrasive segment of the type generally used to form a segmented grinding wheel assembly of a rotary surface grinder. The band serves to cushion the segment relative to a chuck of the grinder. The band is provided with a predetermined original or untensioned circumference and is elastically deformable or stretchable to a larger circumference within a predetermined range of circumferences. This ability to elastically deform facilitates installation onto the segment and enables a single band to be used in combination with segments of various size. The band is preferably installed over a segment having a circumference greater than the band's original circumference so that tension in the installed band serves to mechanically fasten the band in position thereon. This mechanical fastening enables a user to easily move the band to various locations on the segment as desired.

44 Claims, 2 Drawing Sheets

ELASTOMERIC MOUNT FOR GRINDING WHEEL, AND GRINDER

BACKGROUND OF THE INVENTION

1. Field of the Invention

This invention relates to rotary grinders and more particularly to mounts for abrasive segments of a segmented rotary grinding wheel.

2. Background Information

In a rotary surface grinder, the grinding wheel used to grind the surface of a workpiece or workpieces may be a solid continuous cylinder or a circular assembly of a number of abrasive segments of generally arcuate shape. The segments are assembled and interconnected to form a generally cylindrical grinding element, one end of which is mounted in the chuck of the grinder. Each segment must be tightly secured and held in place relative to other segments to maintain a flat grinding face and generally cylindrical configuration, no part of which should loosen or shift during grinding operations.

Typically, grinding wheel segments comprise abrasive particles such as aluminum oxide, silicon carbide, or combinations thereof, of various hardnesses. The particles are bonded together in a conventional manner such as with vitrified, plastic or resinoid bonds. To hold assembled segments together properly it is necessary to use some form of clamping device. The segments and clamping devices are, however, subject to excess wear or damage due to abrasion if the clamping devices are maintained in direct contact with the surfaces of the segments. Moreover, the segments tend to have irregular surfaces including high spots, which, if contacted directly by the clamps tend to generate relatively high stress concentrations within the segment. These stress concentrations may in turn result in segment breakage.

To avoid such damage and/or breakage and yet to securely mount the segments, it has been the practice to cement individual pads of an organic gasket material, such as those sold under the Vellumoid® trademark, onto the surfaces of each segment. These pads are generally four in number and serve to cushion and generally compensate for any surface irregularities in the area of contact between the segments and the clamping devices of the chuck. Although these basic protective functions may be served by the individual pads, other problems remain. For example, the cement joint between one or more of the pads and the segment is subject to failure during the grinding operation. Such failure of a cement joint may cause loss of proper mounting of the segment necessitating cessation of production to permit correction.

Another disadvantage of the use of individually glued pads is the amount of time necessary for the gluing operation. This time consuming gluing operation adds significant expense to the cost of the abrasive segment.

A further drawback of this approach is that operators involved in solvent-based gluing operations may be undesirably exposed to solvent vapors over extended periods of time.

One attempt to overcome the problems associated with the use of the Vellumoid pads includes the use of a plastomeric cap or sleeve as disclosed in U.S. Pat. No. 4,961,290. The cap includes depending flaps and is slidingly fitted over an end of each segment so that the clamping devices or clamps of the chuck bear upon the flaps. While this approach may overcome some of the problems associated with the pads, it is not without its drawbacks. In particular, in order to provide the requisite sliding fit, such a cap must be designed and manufactured to match the specific dimensions of the abrasive element for which it is intended to be used. Since abrasive elements are available in a wide variety of sizes and shapes, a similarly wide variety of caps must be provided to accommodate them. Moreover, the caps must be manufactured with relatively close tolerances in order to achieve the desired sliding fit. Accordingly, the multiple sets of tooling required to produce each of the various sized caps, and the degree of precision required to achieve the relatively close dimensional tolerances, contribute disadvantageously to the expense of this approach.

A further drawback of both the prior art caps and pads, relates to provisions for ensuring compatibility with various rotary grinders. In this regard, rotary grinders, particularly those which have been repaired or remanufactured, tend to be less than perfectly uniform from machine to machine. The clamping devices or chuck clamps of these machines thus tend to engage the segments at varied axial locations or at varied locations along the dimension of the segment parallel to the axis of rotation of the grinder. To compensate for these variations, it is common practice to provide the caps and pads with generally oversized engagement surfaces to help ensure full engagement of the clamps with the pads or caps over a relatively wide range of axial variation in clamp placement. While such oversizing may help ensure improved compatibility of the segments with various rotary grinders, it presents significant disadvantages. In particular, in many grinders, such oversizing tends to extend the cap or pads of a fully installed segment a substantial axial distance beyond the clamps toward the workpiece. This axial extension is exacerbated in the event the operator has engaged in the common practice of attempting to increase the working life of a pad equipped segment by inserting a spacing block between the chuck and the segment in order to effectively shift the segment axially towards the workpiece relative to the clamp.

Since the grindable area of the segments includes the portion thereof between the workpiece and the clamps, the segments are typically ground past the point where the pads or caps are located. Disadvantageously, however, as a pad equipped segment is ground down to the point where the pads meet the workpiece, the pads tend to wipe the surface of the workpiece and collect grinding swarf between the pads and the segment. This wiping action, combined with the propensity of collecting swarf, may adversely impact the preciseness of the grinding process by inhibiting the flow of coolant across the workpiece. Moreover, the pads may not wear off in fine particles as the abrasive segment does, but rather, tend to break off in relatively large pieces. These pieces can clog the coolant system, again causing interference with production because of machine downtime while corrective measures are taken. While the plastomer caps may have overcome some of the drawbacks of the pads, the plastomer caps disadvantageously tend to vibrate and generate undesirable high frequency noise when they meet the workpiece.

Thus, a need exists for a mount for securing abrasive grinder segments to a chuck of a rotary grinder, which overcomes the drawbacks of the prior art.

SUMMARY OF THE INVENTION

According to a first aspect of this invention, a mount adapted to secure a segment of a segmented grinding wheel to a chuck of a rotary grinder, includes an elastomeric band having a predetermined original circumference and which is elastically deformable over a predetermined range of circumferences from the predetermined original circumference to a fully tensioned circumference. The predetermined range of circumferences is determined to include a circumference of the segment to facilitate engagement of the elastomeric band about the circumference of the segment. Once so engaged with the segment, the elastomeric band is engageable by a clamp to secure the segment to the chuck.

The present invention provides, in a second aspect, a segment assembly adapted for being secured to a chuck of a rotary grinder for formation of a segmented grinding wheel.

The segment assembly includes a segment of abrasive particulate bonded in a matrix of a predetermined size and shape and circumference. An elastomeric band is provided which has a predetermined original circumference and which is elastically deformable over a predetermined range of circumferences defined by the predetermined original circumference and a fully tensioned circumference. The predetermined range of circumferences is determined to include the predetermined circumference of the segment. The elastomeric band is conformably and releasably engaged about the predetermined circumference of the segment. Once so engaged, the elastomeric band is engageable by a clamp to secure the segment assembly to the chuck.

According to a third aspect of the invention, a method of securing a segment of a segmented grinding wheel to a chuck of a rotary grinder, includes the step of determining a circumference of the segment and providing an elastomeric band which has a predetermined original circumference and which is elastically deformable over a predetermined range of circumferences from the predetermined original circumference to a fully tensioned circumference. The predetermined range of circumferences is determined to include the circumference of the segment. Further steps include placing the elastomeric band about the circumference of the segment and engaging the elastomeric band with a clamp to secure the segment to the chuck.

According to a fourth aspect of the invention, a method of fabricating a segment assembly adapted for being secured to a chuck of a rotary grinder for formation of a segmented grinding wheel, includes the steps of fabricating a segment of abrasive particulate bonded in a matrix of a predetermined size, shape and circumference and providing an elastomeric band having a predetermined original circumference and being elastically deformable over a predetermined range of circumferences from the predetermined original circumference to a fully tensioned circumference. The predetermined range of circumferences include the circumference of the segment. A further step includes placing the elastomeric band about the circumference of the segment, wherein the elastomeric band is engageable by a clamp to secure the segment assembly to the chuck.

The present invention thus provides a relatively simple and inexpensive means for overcoming the disadvantages of the prior art.

The above and other objects, features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figure 1:
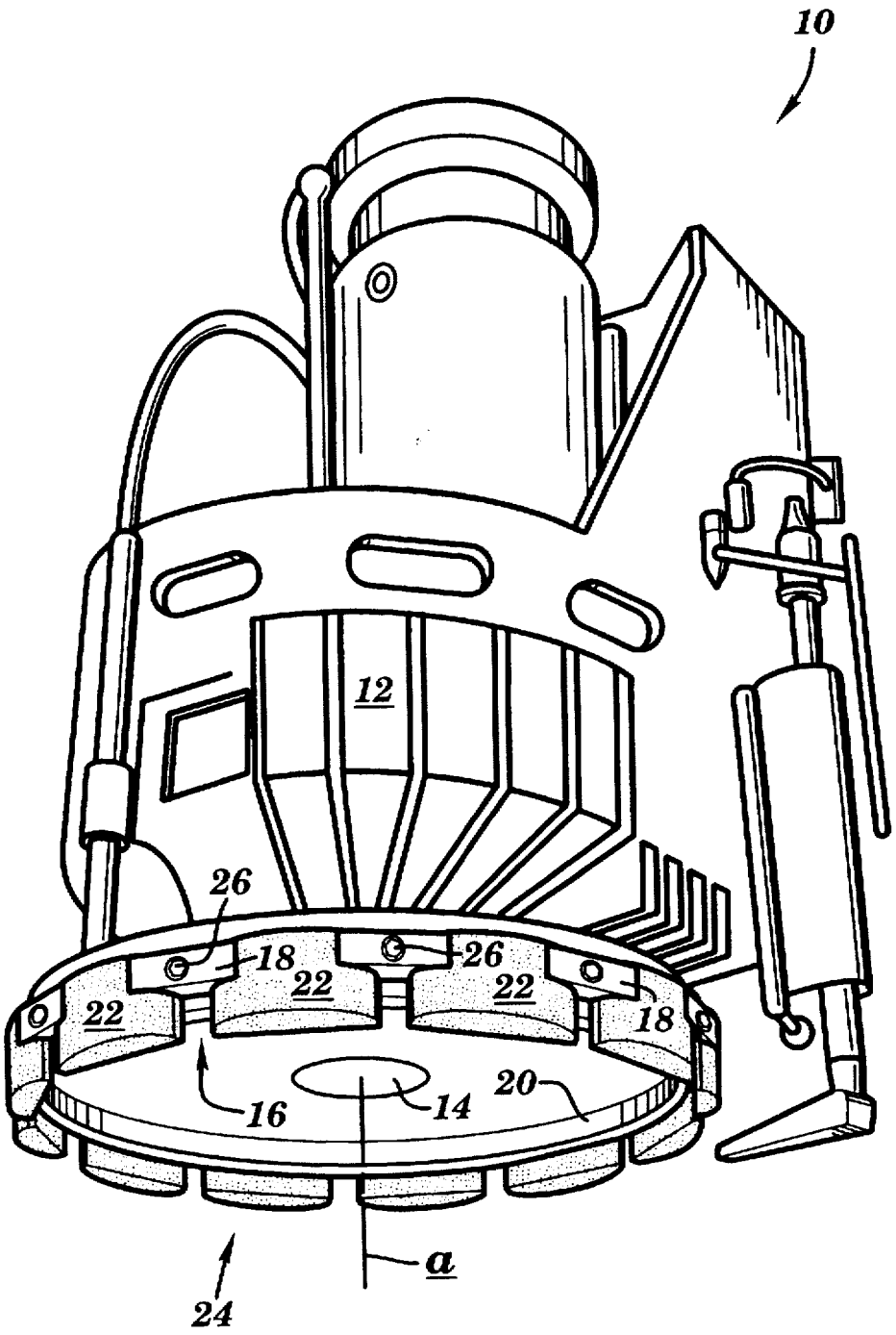
FIG. 1 PRIOR ART
FIG. 1 is a perspective view of a conventional rotary surface grinder including a conventional segmented grinding wheel mounted in the head thereof.
Figure 2:
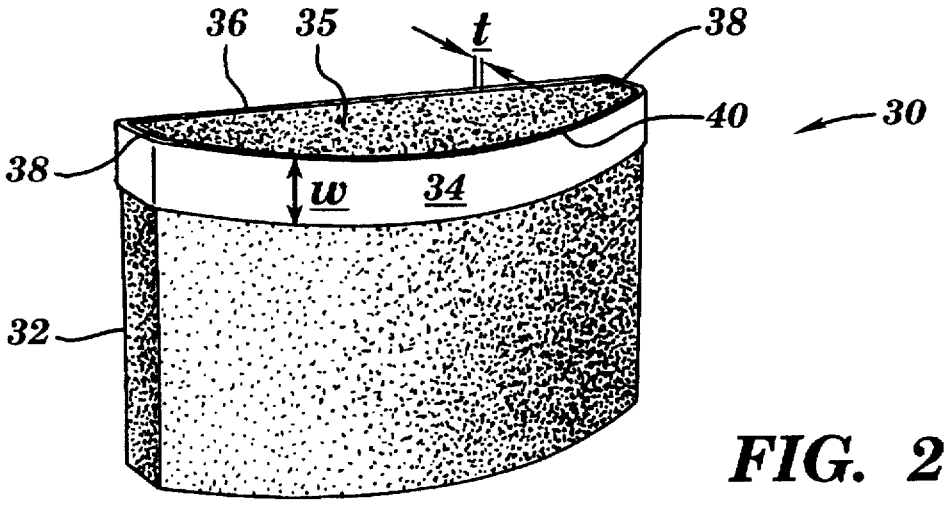
FIG. 2 is a perspective view of a preferred embodiment of an elastomeric mount of the present invention installed onto a segment adapted for use in the segmented grinding wheel of FIG. 1.

Briefly described, referring to FIGS. 1 & 2, the present invention includes an elastomeric mount or band 34 (FIG. 2) generally resembling a rubber band, that is placed circumferentially about a segment 32 (FIG. 2) of the type generally used to form a segmented grinding wheel assembly 24 of a rotary surface grinder 10 (FIG. 1). The band serves to cushion the segment relative to a chuck 16 of grinder 10 (FIG. 1). Band 34 is provided with a predetermined original or untensioned perimeter or circumference and is elastically deformable or stretchable to a larger circumference within a predetermined range of circumferences. This ability to elastically deform facilitates installation of band 34 and enables a single band to be used in combination with segments of various size. Band 34 is preferably installed over a segment 34 having a circumference greater than the band's original circumference so that tension in the installed band serves to mechanically fasten the band in position thereon. This mechanical fastening, as opposed to conventional chemical or adhesive fastening, enables a user to easily move the band to various locations on the segment as desired, as will be discussed in greater detail hereinafter.

Referring now to the drawings in detail, as shown in FIG. 1, a conventional rotary surface grinder 10 includes a wheel head 12 and spindle 14. A segment chuck 16 is mounted on spindle 14 and includes a series of clamps 18 spaced circumferentially about a drum 20. The clamps serve to tightly maintain a series of conventional segments 22, of the type discussed hereinabove, against drum 20 to collectively form a segmented grinding wheel assembly 24. The grinder operates in a conventional manner, wherein spindle 14 and drum 20 are rotated about their coaxis or center of rotation a to rotate the segments for grinding a surface of a workpiece (not shown). As shown, each clamp 18 typically bridges two adjacent segments 22, with a bolt 26 passing through each clamp 18 between the adjacent segments to be threadably tightened to drum 20. As discussed hereinabove, pads (not shown) have commonly been adhesively secured to each segment 22 to provide cushioning between each segment and respective clamp 18, and between each segment and drum 20.

For definitional purposes, throughout this disclosure, the term "axial" refers to a direction which is substantially parallel to the center of rotation of grinder 10 as shown in FIG. 1. Similarly, the term "transverse" shall refer to a direction substantially orthogonal to the axial direction. The terms "transverse cross-section" or "transverse circumference" shall refer to a cross-section or circumference, respectively, taken along a plane oriented substantially orthogonally to the axial direction.

Referring now to FIG. 2, the present invention is embodied in an abrasive segment assembly 30 adapted for use in a rotary grinder such as grinder 10 described hereinabove. Segment assembly 30 comprises a segment 32 and mount or band 34 disposed about a transverse circumference of the segment in a manner which will be discussed in greater detail hereinafter with regard to the installation of the present invention.

Segment 32 is substantially similar to segment 22 described hereinabove, comprising a bonded abrasive segment of the type commercially available from Norton Company of Worcester, Massachusetts. Segment 32 may be fabricated in various sizes and shapes for interfitting with various makes and models of rotary grinders. In a preferred embodiment, however, the subject invention is designed for use in conjunction with segments having a transverse cross-section defined by straight or convex edges, without, or with only minimal, concave edges. Such a substantially non-concave transverse cross-section serves to substantially preclude formation of gaps between the segment and a preferred embodiment of band 34 installed as shown in FIG. 2, under tension, as will be described in greater detail hereinafter. Segments of the type designed for use in a chuck commonly known as a "Cortland" chuck, such as "Style CD" segments available from Norton Company, are suitable examples of segments having such substantially non-concave transverse cross-sections and are generally the type shown in the FIGS. as segments 22 and 32, respectively. Additional examples of suitable segments having substantially non-concave transverse cross-sections include styles "RA", "SA", "SO", "SB" and "SC", also available from Norton Company. Norton Company style "HI", "DIA" and "DIL" segments having transverse cross-sections defined by relatively insubstantial concavities may also be adequately "substantially non-concave" for purposes of utilization with a preferred embodiment of the present invention.

As also shown in FIG. 2, a transverse cross-section of segment 32 is shown at transverse surface 35 thereof and is generally defined by a straight inner edge 36, side edges 38 which extend generally orthogonally from inner edge 36 and a convex outer edge 40. The combined length of these edges define a cross-sectional or transverse circumference of segment 32.

Mount or band 34 preferably comprises a generally cylindrical loop of elastomeric material which, as mentioned hereinabove, serves to cushion the segment when installed in chuck 16 of the rotary grinder. Band 34 is preferably fabricated from a high density elastomeric polymer such as natural or synthetic rubber, as will be discussed in greater detail hereinafter, to generally resemble a conventional rubber band.

Band 34 is provided with predetermined physical characteristics, including an original or untensioned circumference, sufficient to permit band 34 to be installed about a transverse circumference of segment 32 as shown in FIG. 2, without deforming the band beyond its elastic limit. In this regard, band 34 is capable of being elastically deformed or stretched from an original or untensioned circumference to a fully tensioned circumference. These circumferences define the band's range of elasticity or range of circumferences. The band is thus fabricated from appropriate materials, with sufficient dimensions so that this range of circumferences is predetermined to include the transverse circumference of a particular segment 32 onto which the band is to be installed. In this manner, band 34 will not be over tensioned, or tensioned beyond its elastic limit, when installed onto a segment 32 as shown in FIG. 2.

Band 34 may be provided with an original or untensioned circumference nominally the same as that of segment 32 onto which it is to be installed, in which case the band will be maintained in position on the segment primarily by the clamping action of clamp 18 relative to drum 20 when segment assembly 30 is installed onto grinder 10 as discussed hereinabove. In a preferred embodiment, however, band 34 may be provided with an original circumference less than the transverse circumference of the segment to produce tension in band 34 which will advantageously serve to help secure the band in its installed or assembled position on segment 32 as shown.

The band's physical parameters are also predetermined in a known manner so as to enable band 34 to be relatively easily assembled onto the segment as will be discussed hereinafter with respect to FIGS. 3–4. In this regard, the band is preferably fabricated with a sufficiently large original circumference to permit the band to be relatively easily elastically deformed to a circumference sufficiently greater than the transverse circumference of segment 32 to facilitate installation of the band onto segment 32.

Band 34 is also provided with a predetermined hardness or durometer measurement and is configured so that when installed as shown, it has a predetermined thickness t. This combination of durometer measurement and thickness t are determined so as to enable band 34 to sufficiently cushion segment 32 when segment assembly 30 is installed in a grinder 10 as discussed hereinabove. Band 34 is also configured so that when installed, it has a predetermined width w (FIG. 4) which is slightly greater than, or preferably nominally equal to the width or axial dimension of clamp 18. This will serve to facilitate full engagement of the clamp with band 34, nominally without having the band extend axially beyond clamp 18 towards the workpiece, as will be discussed in greater detail hereinafter with respect to the installation and operation of the present invention.

One skilled in the art will recognize that thickness t and width w will vary depending on the amount of tension placed on band 34 when installed about segment 32 as shown in FIG. 2. Thus, for example, a band 34 having an installed circumference of 160 percent of its original circumference will have a smaller thickness t and width w than the same band stretched to an installed circumference of only 110percent of its original circumference.

Band 34 is preferably fabricated from an elastomer that is relatively abrasion resistant, tear resistant and resistant to conventional lubricating oils and coolants commonly used in grinding operations. One skilled in the art will recognize that conventional grinding operation coolant/lubricants are generally water-based materials containing emulsified oils, rust-inhibitors and other common additives. In this regard, however, it should be noted that other types of coolant fluids, such as those containing metal salts (e.g., salts of manganese, copper, iron, nickel and cobalt) tend to disadvantageously promote oxidation of elastomeric components and accordingly, use of such coolants in applications involving the present invention should be avoided.

Examples of elastomers generally meeting the above-described requirements and which may therefore be suitable for use in the present invention include, but are not limited to, natural rubber, styrene-butadiene rubber (SBR), polyisoprene rubbers (IR), polybutadiene rubbers (BR), nitrile rubbers (NBR), polyurethanes (AU or EU), polyacrylate rubbers (ACM) and flouroelastomers (FDM).

An example of a preferred material for band 34 is a vulcanized natural Hevea rubber including additives of approximately 10% by weight clay filler (non-crystalline hydrated amorphous silica). The additives may also include up to 0.05% by weight of a combination of wax, titanium dioxide, sulphur, stearic acid, antioxidant, and an accelerator such as benzothiazyl disulfide (MBTS). This material is available from, for example, Worcester Industrial Rubber & Supply Co., Inc., of Worcester, Massachusetts.

An example of a preferred embodiment of the present invention includes a band 34 constructed from the above described natural rubber, having a durometer measurement of approximately 40 and original or untensioned dimensions of nominally 22 inches (56 cm) in circumference, 1.5 inches (4 cm) in width and 1/16th inch (0.16 cm) in thickness. This band has a preferred maximum elongation or fully tensioned circumference of approximately 250 to 300 percent of its original circumference. It is preferably installed over "Cortland" style segments 32 having transverse cross-sectional dimensions of 11.25 inches (28.6 cm) in length by 2.25 inches (5.7 cm) in width, where the length is the length of inner edge 36 and the width is the maximum distance between inner edge 36 and outer edge 40. This band may also be acceptably installed over a similar segment 32 having the same 11.25 inch (28.6 cm) length and a larger, 3 inch (7.6 cm) width as shown in FIGS. 2–4. This range of acceptable variation in the transverse cross-sectional dimensions of segment 32 corresponds to varying the cross-sectional area of the segment from approximately 18 square inches (116 $cm^2$) to approximately 27 square inches (174 $cm^2$). Moreover, this variation corresponds to band 34 having an installed circumference which ranges from approximately 110 to 170 percent of its non-tensioned or original nominally 22 inch (56 cm) circumference. Thus, advantageously, the present invention enables a single band 34 to be used in conjunction with various sizes of segments 32, to reduce tooling and inventory costs associated with the bands.

A preferred embodiment of the invention having been fully described, the following is a description of the installation and operation thereof.

Figure 3:
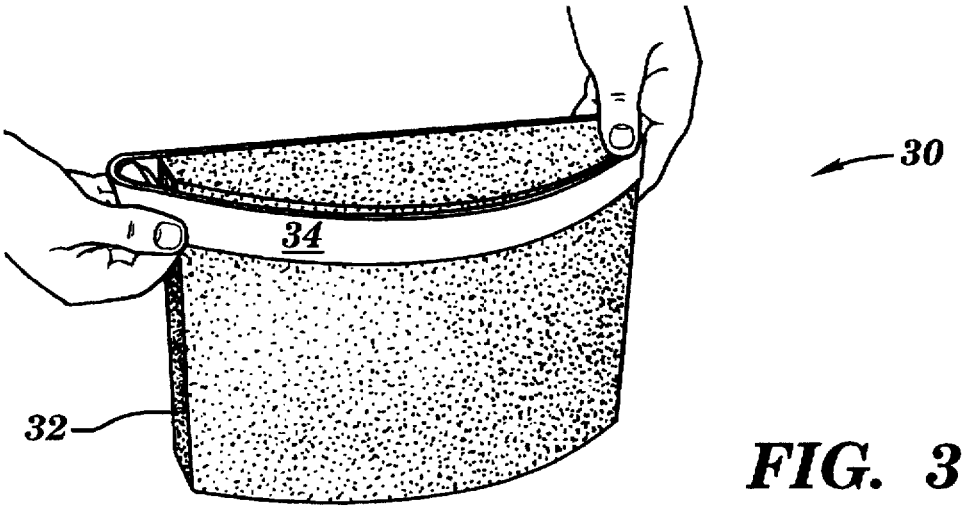
FIG. 3 is a view similar to that of FIG. 2, with the elastomeric mount of the present invention in an initial step in the installation thereof onto the segment.
Figure 4:
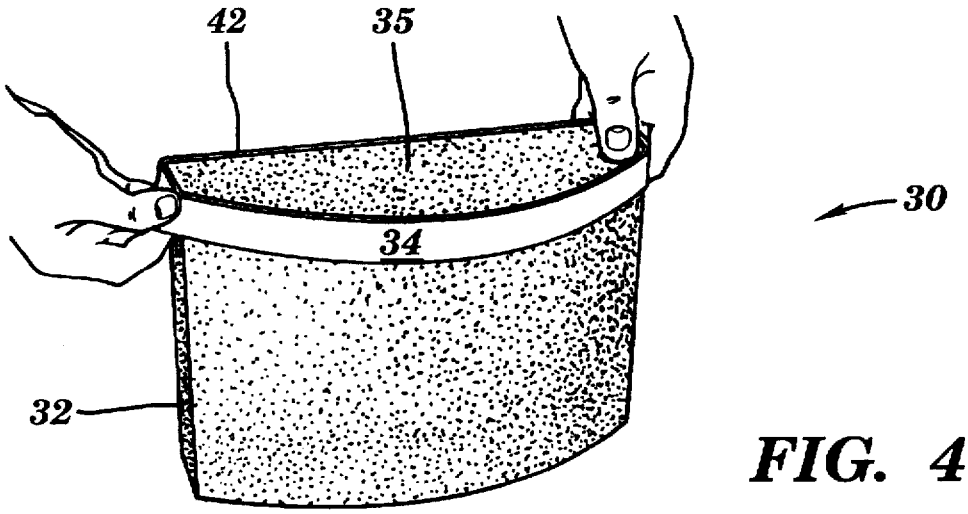
FIG. 4 is a view similar to that of FIG. 3, with the elastomeric mount of the present invention in a further step in the installation thereof onto the segment.

Referring now to FIG. 3, a preferred embodiment of band 34 may be relatively easily manually installed onto segment 32 by initially stretching or applying a load to the band to elastically deform it to a circumference greater than the circumference of the segment. The elastomeric band may then be placed in superposed, substantially concentric orientation about the circumference of the segment as shown. The band may then be released to thus remove the load and permit the band to contract and conformably engage the circumference of the segment as shown in FIG. 4. The band is preferably released while maintaining edge 42 of the band in generally coplanar alignment with transverse surface 35 of segment 32 as shown in FIG. 4. In this manner, band 34 is installed proximate and substantially parallel to transverse surface 35 of segment 32. Band 34 may alternatively be installed at other axial locations on segment 32 to compensate for variations in placement of clamps 18, as will be discussed hereinafter. In a further alternative, band 34 may be similarly installed using a suitable automated process.

Although the present invention is shown and described herein with respect to a band 34 formed discretely and subsequently installed onto segment 32, the band may alternatively be formed in-situ on a segment 32. This approach may be utilized by applying a rubber compound of a type described hereinabove, directly onto the segment prior to the final vulcanizing or curing step. Such an approach may include molding the rubber compound, or depositing the rubber compound in a generally liquid form, directly onto the segment. For example, the band may be formed in a manner similar to conventional rubber dip forming, in which segment 32 may be dipped into a rubber cement solution formed by mixing a rubber composition in an organic solvent. After dipping, the solvent is then permitted to evaporate to deposit a rubber film on the segment. In this manner, the segment takes the place of the form typically used in such rubber dipping operations. The rubber compound may then be vulcanized in-situ on the segment by any conventional method such as steam curing, hydraulic curing, air curing, mold curing, or a combination thereof to complete the fabrication of the band.

In a variation of such in-situ forming, band 34 may be fabricated from an elastomer commonly referred to as a "thermoplastic rubber" which has the properties of vulcanized rubber at moderate ambient temperatures, but which at elevated temperatures is melt-processable in a manner similar to thermoplastics. Examples of such a thermoplastic rubber include styrene-butadiene block copolymers (YSBR), styrene-isoprene rubber (YSIR), vinyl acetate-ethylene copolymers (YEAM) and polyolefins (YEPM). Such a material may thus be applied to a segment 32 in its melted form, such as by injection molding, and subsequently cooled to form band 34 in-situ on the segment without the need for a postcure operation. Alternatively, band 34 may be fabricated from a polymeric composition including elastomers and a moisture curable interpenetrating network of polymers.

An advantage of such in-situ forming is that the present invention may be practiced in conjunction with a wider range segment shapes, such as with segments having transverse circumferences defined by generally concave surfaces. In addition, by potentially eliminating steps in the manufacture of segment assembly 30, in-situ forming may provide manufacturing cost savings.

Placement of the band as shown in FIG. 2 is generally preferred. However, since the band is mechanically rather than adhesively secured to the segment, the band may be easily moved to any other axial location along segment 32 by substantially repeating the installation process described hereinabove. This user-adjustability thus provides the advantage of substantially eliminating the need to oversize width w of band 34 to allow for individual variations in axial placement of clamps 18 on grinders 10. Indeed, as mentioned hereinabove, the predetermined installed width w may be determined to closely approximate the axial dimension of clamp 18, to virtually eliminate the possibility of the band extending beyond the clamp axially towards the workpiece. This construction thus eliminates the prior art problem of the pads wiping the surface of the workpiece and collecting grinding swarf between the pads and the segment, as well as the problem of the pads breaking off in relatively large pieces and clogging the coolant system. This construction thus also solves the similar problem of the prior art plastomer caps' tendency to vibrate against the workpiece and generate undesirable high frequency noise.

A further advantage of the present invention is the elimination of the gluing operation associated with the aforementioned pads. Elimination of this step serves to substantially reduce the time and expense associated with installation, eliminate the problem of operators being exposed to glue vapors and also eliminate the possibility of glue failure during the grinding operation.

A further advantage of the glueless approach of the present invention becomes evident with respect to the aforementioned use of a spacer with segment 32. In the event such a spacer is utilized, the band may be moved axially to straddle and thus partially engage both the spacer and the segment at nominally the same axial position as clamp 18.

In this manner, band 34 may help to maintain the segment in unified contact with the spacer while providing a cushion between the clamp and the spacer as well as between the clamp and the segment. The spacer and segment combination may thus be more securely and easily retained within chuck 16 for improved safety.

Moreover, the present invention provides the advantage of being relatively simple and inexpensive to manufacture. Indeed, installation of the band onto a segment 35 may be accomplished relatively quickly and easily without the use of any special equipment, either by the manufacturer or by a customer or user. Advantageously, this feature serves to provide relatively low assembly costs while also facilitating replacement of bands by a customer or user if necessary.

While the present invention is shown and described herein with respect to a specific example of a rotary surface grinder, it should be recognized by one skilled in the art that the invention may be utilized in combination with any axially fed rotary grinder, including vertically and horizontally oriented grinders, without departing from the spirit and scope of the invention.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is:

1. A rotary surface grinder comprising a chuck, a segmented grinding wheel and a mount adapted to secure a segment of the segmented grinding wheel in the chuck, the mount comprising:

an elastomeric band having a predetermined original circumference and being elastically deformable over a predetermined range of circumferences from said predetermined original circumference to a fully tensioned circumference;

the elastomeric band being deformable around a circumference of the segment to engage the circumference of the segment, wherein the elastomeric band is engageable by a clamp to secure the segment to the chuck.

2. The rotary surface grinder as set forth in claim 1, wherein said elastomeric band is selectively engageable with and releasable from the circumference of the segment.

3. The rotary surface grinder as set forth in claim 2, wherein said elastomeric band is selectively moveable relative to the segment to align said elastomeric band with the clamp.

4. The rotary surface grinder as set forth in claim 3, wherein said elastomeric band further comprises a predetermined width which is nominally equal to an axial dimension of the clamp.

5. The rotary surface grinder as set forth in claim 1, wherein said predetermined original circumference of said elastomeric band is less than the circumference of the segment so that tension in said elastomeric band serves to releasably fasten said elastomeric band to the segment.

6. The rotary surface grinder as set forth in claim 1, wherein said elastomeric band is conformably engageable with edges defining the circumference of the segment.

7. The rotary surface grinder as set forth in claim 6, wherein the circumference of the segment is substantially non-concave and said elastomeric band is conformably engageable in substantially superimposed relation with all edges defining the circumference of the segment.

8. The rotary surface grinder as set forth in claim 1, wherein the mount has been formed by curing an uncured elastomeric material in-situ on the segment.

9. The rotary surface grinder as set forth in claim 8, wherein said elastomeric band is selectively engageable with and releasable from the circumference of the segment for selective movement of said elastomeric band relative to the segment to align said elastomeric band with the clamp.

10. The rotary surface grinder as set forth in claim 9, wherein said elastomeric band is selectively engageable in superimposed relation with the circumference of the segment.

11. The rotary surface grinder as set forth in claim 1, wherein said elastomeric band is fabricated from an elastomeric polymer.

12. The rotary surface grinder as set forth in claim 11, wherein said elastomeric band is fabricated from a high density polymer selected from the group consisting of natural rubber, styrene-butadiene rubber, polyisoprene rubber, polybutadiene rubber, nitrile rubber, polyurethane, polyacrylate rubber, fluoroelastomers, styrene-butadiene block copolymers, styrene-isoprene rubber, vinyl acetate-ethylene copolymers and polyolefins.

13. The rotary surface grinder as set forth in claim 11, wherein said elastomeric band is fabricated from at least one rubber.

14. The rotary surface grinder as set forth in claim 13, wherein said elastomeric band is fabricated from a substantially abrasion resistant rubber having a durometer measurement within a range of approximately 30 to 50.

15. The rotary surface grinder as set forth in claim 14, wherein said abrasion resistant rubber has a durometer measurement of approximately 40.

16. The rotary surface grinder as set forth in claim 1, wherein said fully tensioned circumference is within a range of approximately 250 to 300 percent of said predetermined original circumference.

17. A segment assembly adapted for being secured to a chuck of a rotary grinder for formation of a segmented grinding wheel, the segment assembly comprising:

a segment of abrasive particulate bonded in a matrix of predetermined size and shape and of a predetermined circumference;

an elastomeric band having a predetermined original circumference and being elastically deformable over a predetermined range of circumferences from said predetermined original circumference to a fully tensioned circumference;

said predetermined range of circumferences determined to include said predetermined circumference of said segment;

said elastomeric band being conformably and releasably disposed about said predetermined circumference of said segment, wherein said elastomeric band is engageable by a clamp to secure the segment assembly to the chuck.

18. The segment assembly as set forth in claim 17, wherein said elastomeric band is selectively engageable with and releasable from the circumference of said segment to facilitate the engagement by the clamp to secure the segment assembly to the chuck.

19. The segment assembly as set forth in claim 18, wherein said elastomeric band is selectively moveable relative to said segment to align said elastomeric band with the clamp.

20. The segment assembly as set forth in claim 19, wherein a portion of said segment is secured within said chuck of said rotary grinder by engagement of said elastomeric band with said clamp, and said elastomeric band has a predetermined width which is sufficient in size to prevent contact between the portion of said segment which is secured within the chuck and the clamp.

21. The segment assembly as set forth in claim 17, wherein said predetermined original circumference of said elastomeric band is less than the circumference of said segment so that tension in said elastomeric band serves to releasably fasten said elastomeric band to said segment.

22. The segment assembly as set forth in claim 17, wherein said elastomeric band is conformably engageable with edges defining the circumference of said segment.

23. The segment assembly as set forth in claim 22, wherein the circumference of the segment is substantially non-concave and said elastomeric band is conformably engageable in substantially superimposed relation with all edges defining the circumference of the segment.

24. The segment assembly as set forth in claim 17, wherein said elastomeric band is formable in-situ on said segment.

25. The segment assembly as set forth in claim 24, wherein said elastomeric band is selectively engageable with and releasable from the circumference of said segment for selective movement of said elastomeric band relative to said segment to align said elastomeric band with the clamp.

26. The segment assembly as set forth in claim 25, wherein said elastomeric band is selectively engageable in superimposed relation with the circumference of the segment.

27. The segment assembly as set forth in claim 17, wherein said elastomeric band is fabricated from an elastomeric polymer.

28. The segment assembly as set forth in claim 27, wherein said elastomeric band is fabricated from a high density polymer selected from the group consisting of natural rubber, styrene-butadiene rubber, polyisoprene rubber, polybutadiene rubber, nitrile rubber, polyurethane, polyacrylate rubber, fluoroelastomers, styrene-butadiene block copolymers, styrene-isoprene rubber, vinyl acetate-ethylene copolymers and polyolefins.

29. The segment assembly as set forth in claim 27, wherein said elastomeric band is fabricated from at least one rubber.

30. The segment assembly as set forth in claim 29, wherein said elastomeric band is fabricated from a substantially abrasion resistant rubber having a durometer measurement within a range of approximately 30 to 50.

31. The segment assembly as set forth in claim 30, wherein said abrasion resistant rubber has a durometer measurement of approximately 40.

32. The segment assembly as set forth in claim 17, wherein said fully tensioned circumference is within a range of approximately 250 to 300 percent of said predetermined original circumference.

33. A method of fabricating a segment assembly adapted for being secured to a chuck of a rotary grinder for formation of a segmented grinding wheel, comprising the steps of:

fabricating a segment of abrasive particulate bonded in a matrix of a predetermined size, shape and circumference;

providing an elastomeric band having a predetermined original circumference and being elastically deformable over a predetermined range of circumferences from the predetermined original circumference to a fully tensioned circumference, the predetermined range of circumferences including the circumference of the segment;

disposing the elastomeric band about the circumference of the segment, wherein the elastomeric band is engageable by a clamp to secure the segment assembly to the chuck.

34. The method of fabricating a segment assembly as set forth in claim 33, wherein said step of disposing the elastomeric band about the circumference of the segment further comprises the steps of:

applying a load to the elastomeric band to elastically deform it to a circumference greater than the circumference of the segment;

placing the elastomeric band in superposed, substantially concentric orientation about the circumference of the segment; and removing the load from the elastomeric band, wherein the elastomeric band contracts to conformably and releasably engage the circumference of the segment.

35. The method of fabricating a segment assembly as set forth in claim 33, further comprising the step of:

selectively elastically deforming the elastomeric band within the predetermined range of circumferences and releasing it to selectively release and engage the circumference of the segment for facilitating engagement of said elastomeric band by the clamp.

36. The method of fabricating a segment assembly as set forth in claim 35, wherein the elastomeric band is selectively moveable relative to the segment to align the elastomeric band with the clamp.

37. The method of fabricating a segment assembly as set forth in claim 35, wherein the predetermined original circumference of the elastomeric band is less than the circumference of the segment so that tension in the elastomeric band releasably fastens the elastomeric band to the segment when the elastomeric band is disposed about the circumference of the segment.

38. The method of fabricating a segment assembly as set forth in claim 33, wherein the steps of providing an elastomeric band and disposing the elastomeric band about the circumference of the segment comprise the step of forming the elastomeric band in-situ on the segment.

39. The method of fabricating a segment assembly as set forth in claim 35, wherein the elastomeric band is fabricated from a elastomeric polymer.

40. The method of fabricating a segment assembly as set forth in claim 39, wherein the elastomeric band is fabricated from a high density polymer selected from the group consisting of natural rubber, styrene-butadiene rubber, polyisoprene rubber, polybutadiene rubber, nitrile rubber, polyurethane, polyacrylate rubber, fluoroelastomers, styrene-butadiene block copolymers, styrene-isoprene rubber, vinyl acetate-ethylene copolymers and polyolefins.

41. The method of fabricating a segment assembly as set forth in claim 39, wherein the elastomeric band is fabricated from at least one rubber.

42. The method of fabricating a segment assembly as set forth in claim 41, wherein the elastomeric band is fabricated from a substantially abrasion resistant rubber having a durometer measurement within a range of approximately 30 to 50.

43. The method of fabricating a segment assembly as set forth in claim 42, wherein the abrasion resistant rubber has a durometer measurement of approximately 40.

44. The method of fabricating a segment assembly as set forth in claim 33, wherein said fully tensioned circumference is within a range of approximately 250 to 300 percent of said predetermined original circumference.

* * * * *